US011217882B2

(12) United States Patent
Luo et al.

(10) Patent No.: US 11,217,882 B2
(45) Date of Patent: Jan. 4, 2022

(54) ANTENNA AND WIRELESS DEVICE

(71) Applicant: Huawei Technologies Co., Ltd., Shenzhen (CN)

(72) Inventors: Xin Luo, Chengdu (CN); Yi Chen, Chengdu (CN); Chuanan Zhang, Chengdu (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 0 days.

(21) Appl. No.: 17/226,637

(22) Filed: Apr. 9, 2021

(65) Prior Publication Data

US 2021/0234262 A1 Jul. 29, 2021

Related U.S. Application Data

(63) Continuation of application No. PCT/CN2018/110076, filed on Oct. 12, 2018.

(51) Int. Cl.
*H01Q 1/36* (2006.01)
*H01Q 11/08* (2006.01)

(52) U.S. Cl.
CPC ..... *H01Q 1/36* (2013.01)

(58) Field of Classification Search
CPC ..... H01Q 1/36; H01Q 11/00; H01Q 11/08; H01Q 11/086; H01Q 25/00; H01Q 25/001; H01Q 5/321
See application file for complete search history.

(56) References Cited

U.S. PATENT DOCUMENTS 3,503,075 A * 3/1970 Gerst ..... H01Q 11/08 342/371
6,025,816 A * 2/2000 Dent ..... H01Q 1/084 343/700 MS
6,133,891 A * 10/2000 Josypenko ..... H01Q 1/362 343/860
6,480,173 B1 11/2002 Marino
6,545,649 B1 * 4/2003 Seavey ..... H01Q 1/242 343/713

(Continued)

FOREIGN PATENT DOCUMENTS

CN 202495575 U 10/2012
CN 104638359 A 5/2015

(Continued)

*Primary Examiner* — Thai Pham
(74) *Attorney, Agent, or Firm* — Conley Rose, P.C.

(57) ABSTRACT

An antenna includes a first helical arm and a second helical arm. The first helical arm is wound clockwise along a longitudinal direction of an axis of the antenna, and the second helical arm is wound counterclockwise along the longitudinal direction of the axis of the antenna. The second helical arm and the first helical arm form at least one intersecting point, a first feeding point is disposed on the first helical arm, a second feeding point is disposed on the second helical arm, the first feeding point and the second feeding point are two points symmetrical relative to the axis of the antenna, and any intersecting point of the at least one intersecting point further forms a third feeding point, where the first feeding point and the second feeding point are connected to a first feeding port, and the third feeding point is connected to a second feeding port.

20 Claims, 5 Drawing Sheets

(56) References Cited

U.S. PATENT DOCUMENTS

| | | | | |
|---|---|---|---|---|
| 6,653,987 | B1 * | 11/2003 | Lamensdorf | H01Q 1/38 343/853 |
| 2008/0094307 | A1 * | 4/2008 | Cowles | H01Q 21/26 343/895 |
| 2018/0205153 | A1 | 7/2018 | Georgakopoulos et al. | |

FOREIGN PATENT DOCUMENTS

| | | | |
|---|---|---|---|
| CN | 205752516 | U | 11/2016 |
| CN | 107104280 | A | 8/2017 |
| CN | 206506019 | U | 9/2017 |
| CN | 107968249 | A | 4/2018 |
| CN | 207183534 | U | 4/2018 |
| CN | 108155460 | A | 6/2018 |
| JP | S6165604 | A | 4/1986 |
| JP | H0766624 | A | 3/1995 |
| JP | 2002076764 | A | 3/2002 |

* cited by examiner

ANTENNA AND WIRELESS DEVICE

CROSS-REFERENCE TO RELATED APPLICATIONS

This is a continuation of Int'l Patent App. No. PCT/CN2018/110076, filed on Oct. 12, 2018, which is incorporated by reference.

FIELD

This disclosure relates to the field of antenna technologies, and in particular, to an antenna and a wireless device.

BACKGROUND

With rapid development of modern communications technologies, people use Wi-Fi more frequently. Currently, Wi-Fi access coverage has been provided in public places such as airports, stations, and large stadiums. These areas feature dense population and a large quantity of concurrent connections. Therefore, a directional antenna with a high gain and a narrow beam is required to centralize signals into a specific area.

Currently, an array antenna is usually used to implement the high gain and the narrow beam. However, the array antenna occupies relatively large space, and consequently, engineering installation is relatively difficult.

A helical antenna is a high-gain antenna which occupies a small area. Different from the array antenna that depends on a quantity of array elements (namely, an array size), the helical antenna uses a helix height to increase the gain. As shown in FIG. 1, a helical antenna includes a metal helical wire 01 with good electrical conductivity and a cylindrical insulation medium 02. The metal helical wire 01 is wound around a helix axis N. The helical antenna is fed by using a coaxial cable 03, a core wire of the coaxial cable 03 is connected to one end of the metal helical wire 01, and an outer conductor of the coaxial cable 03 is connected to a ground plane 04. A radiation direction of the helical antenna is related to a circumference of the metal helical wire 01 (that is, a circumference of a cross section of the cylindrical insulation medium 02). When the circumference of the metal helical wire 01 is much less than one wavelength, a direction with strongest radiation is perpendicular to the helix axis N; or when the circumference of the metal helical wire 01 is an order of magnitude of one wavelength, strongest radiation appears in a direction of the helix axis N. However, a polarization direction of a single-arm helical antenna is circular polarization, and a polarization direction of an antenna on a mobile phone is linear polarization. As a result, if a Wi-Fi device uses a circularly polarized antenna, receive power of the mobile phone decreases by 3 dB.

In the conventional technology, there is a double-arm helical antenna with a single linear polarization direction. The antenna includes two metal helical arms. A first metal helical arm and a second metal helical arm are wound from symmetrical positions in forms of a left-hand helix and a right-hand helix respectively, and overlap every half turn. A feeding port is arranged at a center of a circle of the bottom of a helix, and is connected to both start points of the left-hand helical arm and the right-hand helical arm by using microstrips. Polarization directions of the two metal helical arms are different, where the polarization direction of the first metal helical arm is left-hand circular polarization, the polarization direction of the second metal helical arm is right-hand circular polarization, and the left-hand circular polarization and the right-hand circular polarization are superposed to form linear polarization.

However, the double-arm helical antenna has only one linear polarization direction. If a device needs two orthogonal linear polarization antennas to implement polarization diversity or polarization multiplexing, two such antennas are required, where one antenna is rotated by 90 degrees relative to the other antenna. This undoubtedly increases device costs and occupied space.

SUMMARY

Embodiments provide an antenna and a wireless device, so as to resolve a problem that an existing linear polarization helical antenna has only one linear polarization direction, and if two linear polarization directions need to be implemented, relatively high costs and relatively large occupied space are caused.

To achieve the foregoing objective, the following technical solutions are used in the embodiments.

According to a first aspect, an antenna includes: a first helical arm, where the first helical arm is wound clockwise along a longitudinal direction of an axis of the antenna; a second helical arm, where the second helical arm is wound counterclockwise along the longitudinal direction of the axis of the antenna, where the second helical arm and the first helical arm form at least one intersecting point, a first feeding point is disposed on the first helical arm, a second feeding point is disposed on the second helical arm, the first feeding point and the second feeding point are two points symmetrical relative to the axis of the antenna, and any intersecting point of the at least one intersecting point forms a third feeding point; a first feeding port, where the first feeding port is connected to both the first feeding point and the second feeding point; and a second feeding port, where the second feeding port is connected to the third feeding point.

The antenna uses two helical arms with opposite winding directions, and three feeding points are disposed on the antenna. The first feeding point and the second feeding point are connected to the first feeding port, and the third feeding point is connected to the second feeding port. Therefore, the helical antenna can be fed at different positions, so that left-hand circular polarization and right-hand circular polarization generate two different start directions, thereby synthesizing two types of linear polarization waves to meet a requirement of polarization diversity or polarization multiplexing. The linear polarization waves in two different directions can be implemented by using one antenna, thereby reducing device costs and occupied space.

In a possible implementation, to prevent the antenna with two linear polarization directions from generating a relatively large phase difference, an intersecting point that is closest to the first feeding point and the second feeding point may be selected as the third feeding point from intersecting points formed by the second helical arm and the first helical arm. In this way, the phase difference generated by the antenna with two linear polarization directions can be minimized.

In a possible implementation, a start end of the first helical arm coincides with a start end of the second helical arm to form an intersecting point. In this case, the coincided intersecting point of the start end of the first helical arm and the start end of the second helical arm may be configured as the third feeding point.

In a possible implementation, a point obtained after the start end of the first helical arm is wound clockwise along the longitudinal direction of the axis of the antenna by 90 degrees is configured as the first feeding point; and a point obtained after the start end of the second helical arm is wound counterclockwise along the longitudinal direction of the axis of the antenna by 90 degrees is configured as the second feeding point. In this way, cross polarization isolation of two types of linear polarization can be improved, so that the two types of linear polarization are purer.

In a possible implementation, a start end of the first helical arm does not coincide with a start end of the second helical arm, and the start end of the first helical arm and the start end of the second helical arm are two points symmetrical relative to the axis of the antenna. In this case, the start end of the first helical arm may be configured as the first feeding point, the start end of the second helical arm may be configured as the second feeding point, and the third feeding point may be an intersecting point that is closest to the start end of the first helical arm and the start end of the second helical arm.

In a possible implementation, the antenna may be further provided with a support column that is made of an insulating material. An axis of the support column coincides with the axis of the antenna, the first helical arm is wound clockwise around a side wall of the support column along the longitudinal direction of the axis of the antenna, and the second helical arm is wound counterclockwise around the side wall of the support column along the longitudinal direction of the axis of the antenna. Therefore, the support column can effectively support the first helical arm and the second helical arm, so that an overall structure of the antenna is more stable and is unlikely to deform or be damaged.

In a possible implementation, the first feeding port may be connected to both the first feeding point and the second feeding point by using a power divider. An input end of the power divider is connected to the first feeding port, one output end of the power divider is connected to the first feeding point, and another output end of the power divider is connected to the second feeding point.

In a possible implementation, the power divider may include a coaxial cable, a first microstrip, and a second microstrip. One end of the first microstrip is connected to a first end of the coaxial cable, and the other end of the first microstrip is connected to the first feeding point. One end of the second microstrip is connected to the first end of the coaxial cable, and the other end of the second microstrip is connected to the second feeding point. A second end of the coaxial cable is connected to the first feeding port.

In a possible implementation, an electrical length of the first microstrip, an electrical length of the second microstrip, an electrical length from the start end of the first helical arm to the first feeding point, and an electrical length from the start end of the second helical arm to the second feeding point are equal to each other.

In a possible implementation, the antenna further includes a ground plane. The start end of the first helical arm and the start end of the second helical arm are disposed close to the ground plane. The coaxial cable includes an inner conductor and an outer conductor, where the outer conductor is disposed outside the inner conductor and is electrically isolated from the inner conductor, the inner conductor is connected to both the first microstrip and the second microstrip, and the outer conductor is connected to the ground plane.

According to a second aspect, a wireless device includes a baseband, a radio frequency module, a cable, and an antenna. The radio frequency module is connected to both the baseband and the antenna by using the cable, where the antenna is the antenna disclosed in the first aspect. The baseband is configured to convert a digital signal into an intermediate frequency analog signal and send the intermediate frequency analog signal to the radio frequency module; the radio frequency module is configured to convert the intermediate frequency analog signal into a radio frequency signal and send the radio frequency signal to the antenna; and the antenna is configured to convert the radio frequency signal into an electromagnetic wave signal and radiate the electromagnetic wave signal in the air.

In a possible implementation of the second aspect, that the radio frequency module converts the intermediate frequency analog signal into the radio frequency signal and sends the radio frequency signal to the antenna includes: converting the intermediate frequency analog signal into the radio frequency signal; sequentially performing amplification processing and filtering processing on the radio frequency signal, to obtain a processed radio frequency signal; and sending the processed radio frequency signal to the antenna. That the antenna converts the radio frequency signal into the electromagnetic wave signal includes: converting the processed radio frequency signal into the electromagnetic wave signal.

In the wireless device, the antenna of the wireless device is provided with two helical arms in opposite winding directions, and three feeding points are disposed on the antenna. The first feeding point and the second feeding point are connected to the first feeding port, and the third feeding point is connected to the second feeding port. Therefore, the helical antenna can be fed at different positions, so that left-hand circular polarization and right-hand circular polarization generate two different start directions, thereby synthesizing two types of linear polarization to meet a requirement of polarization diversity or polarization multiplexing. Two different linear polarization directions can be implemented by using one antenna, thereby reducing device costs and occupied space.

DETAILED DESCRIPTION

Figure 1:
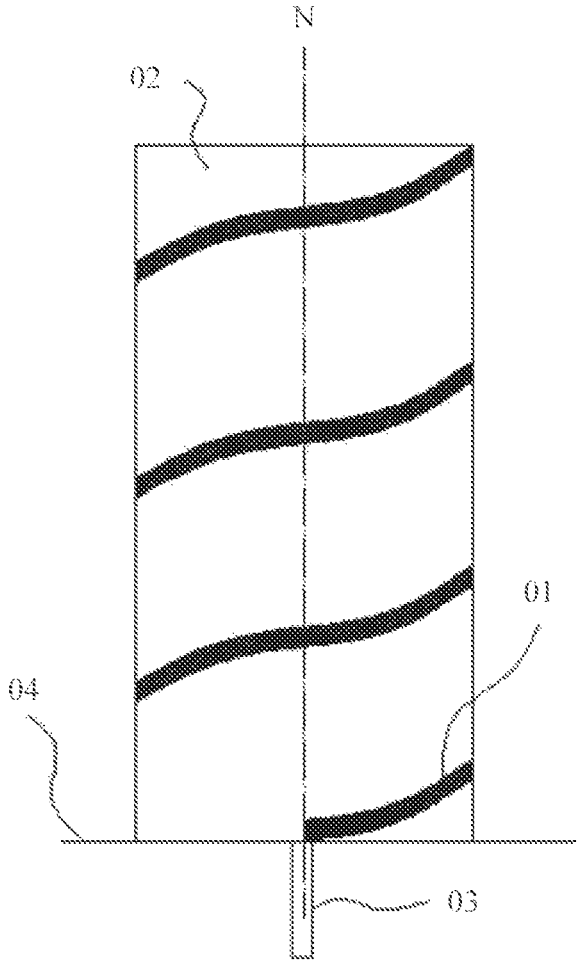
FIG. 1 is a schematic structural diagram of a single-arm helical antenna.

Embodiments relate to an antenna and a microwave transmission device. Concepts in the foregoing embodiments are simply described below:

Antenna: The antenna is a converter that converts a guided wave propagated on a transmission line into an electromagnetic wave propagated in an unbounded medium (free space in most cases) or performs a reverse conversion.

Helical antenna: The helical antenna is an antenna in a shape of a helix. The helical antenna includes a metal helical wire with good electrical conductivity and is fed generally by using a coaxial cable. A core wire of the coaxial cable is connected to one end of the helical wire, and an outer conductor of the coaxial cable is connected to a grounded metal mesh (or plane). A radiation direction of the helical antenna is related to a circumference of the helical wire.

When the circumference of the helical wire is much less than one wavelength, a direction with strongest radiation is perpendicular to a helix axis; or when the circumference of the helical wire is an order of magnitude of one wavelength, strongest radiation appears in a direction of the helix axis.

Polarization direction: The polarization direction of the antenna is defined as a spatial orientation of an electric field strength vector of an electromagnetic wave radiated by the antenna in a maximum radiation direction, and is a parameter that describes the spatial direction of a vector of the electromagnetic wave radiated by the antenna. Because there is a constant relationship between an electric field and a magnetic field, a polarization direction of the electromagnetic wave radiated by the antenna is represented by the spatial orientation of an electric field vector.

Linear polarization: Polarization in which a spatial orientation of an electric field vector is constant is referred to as the linear polarization.

Circular polarization: When an included angle between a plane of polarization and a normal plane of the earth changes periodically from 0 to 360 degrees, to be specific, a size of the electric field is unchanged, and a direction changes with time, and a track of a tail end of the electric field vector is projected as a circle on a plane perpendicular to a propagation direction, the polarization is referred to as the circular polarization.

Right-hand circular polarization: If the plane of polarization rotates with time and forms a right-hand helix relationship with a propagation direction of the electromagnetic wave, the polarization is referred to as the right-hand circular polarization.

Left-hand circular polarization: If the plane of polarization rotates with time and forms a left-hand helix relationship with the propagation direction of the electromagnetic wave, the polarization is referred to as the left-hand circular polarization.

Polarization diversity: During the polarization diversity, same signals are transmitted by using different polarization, to improve reliability of signal transmission.

Polarization multiplexing: During the polarization multiplexing, different signals are transmitted by using different polarization, to increase a transmission capacity.

Figure 2:
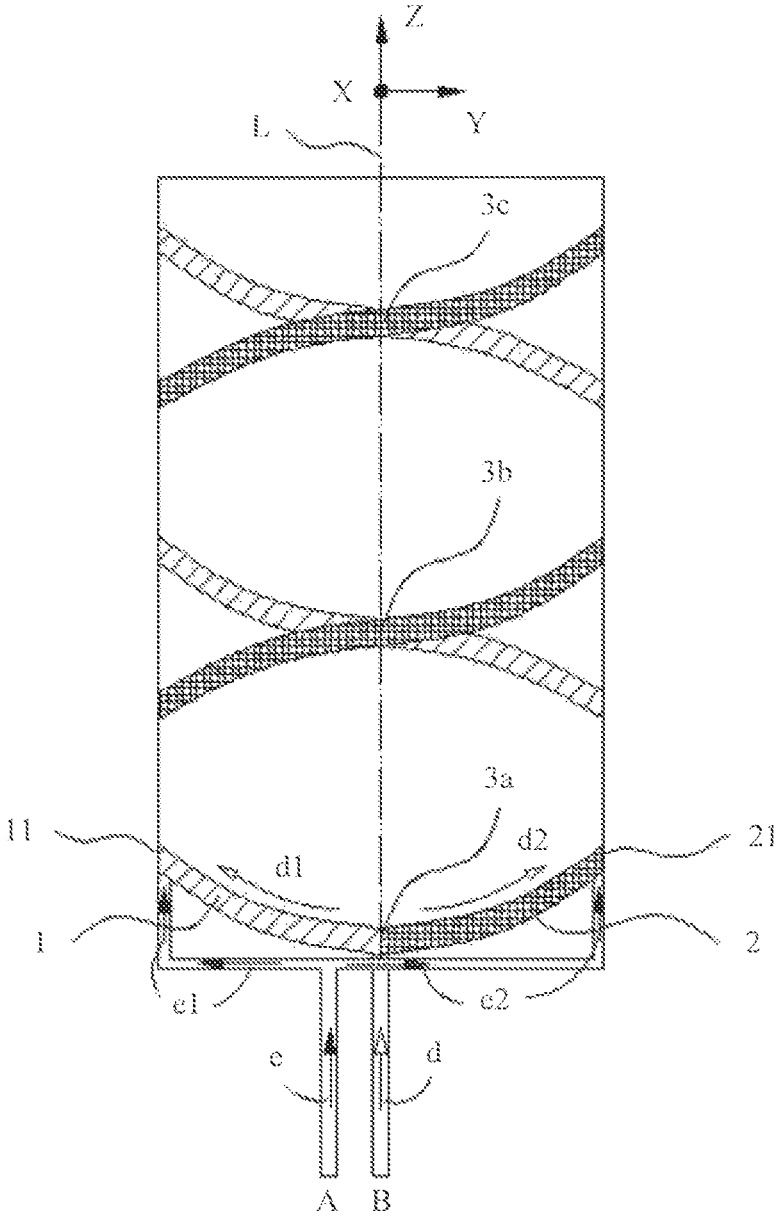
FIG. 2 is a schematic structural diagram of an antenna according to an embodiment.

As shown in FIG. 2, the embodiments provide an antenna. The antenna includes a first helical arm 1 and a second helical arm 2. The first helical arm 1 is wound clockwise along a longitudinal direction of an axis L of the antenna, and the second helical arm 2 is wound counterclockwise along the longitudinal direction of the axis of the antenna. The second helical arm 2 and the first helical arm 1 form a plurality of intersecting points (3*a*, 3*b*, and 3*c*), a first feeding point 11 is disposed on the first helical arm 1, a second feeding point 21 is disposed on the second helical arm 2, the first feeding point 11 and the second feeding point 21 are two points symmetrical relative to the axis of the antenna, and one intersecting point 3*a* of the at least one intersecting point (3*a*, 3*b*, and 3*c*) forms a third feeding point. The first feeding point 11 and the second feeding point 21 are connected to a first feeding port A, and the third feeding point is connected to a second feeding port B.

The antenna uses two helical arms with opposite winding directions, and three feeding points are disposed on the antenna. The first feeding point 11 and the second feeding point 21 are connected to the first feeding port A, and the third feeding point is connected to the second feeding port B. Therefore, the helical antenna can be fed at different positions, so that left-hand circular polarization and right-hand circular polarization generate two different start directions, thereby synthesizing two types of linear polarization waves to meet a requirement of polarization diversity or polarization multiplexing. The linear polarization waves in two different directions can be implemented by using one antenna, thereby reducing device costs and occupied space.

Specifically, the third feeding point may be any intersecting point of the intersecting points (3*a*, 3*b*, and 3*c*) formed by the second helical arm 2 and the first helical arm 1. To prevent the antenna with two linear polarization directions from generating a relatively large phase difference, an intersecting point that is closest to the first feeding point 11 and the second feeding point 21 may be selected as the third feeding point from the intersecting points (3*a*, 3*b*, and 3*c*) formed by the second helical arm 2 and the first helical arm 1. In this way, the phase difference generated by the antenna with two linear polarization directions can be minimized. For example, referring to FIG. 2, from the intersecting point 3*a*, the intersecting point 3*b*, and the intersecting point 3*c*, the intersecting point 3*a* that is closest to the first feeding point 11 and the second feeding point 21 may be selected as the third feeding point.

In the antenna, a start end of the first helical arm 1 may or may not coincide with a start end of the second helical arm 2. In a possible implementation, as shown in FIG. 2, the start end of the first helical arm 1 coincides with the start end of the second helical arm 2 to form the intersecting point 3*a*. In this case, the coincided intersecting point 3*a* of the start end of the first helical arm 1 and the start end of the second helical arm 2 may be configured as the third feeding point.

For positions of the first feeding point 11 and the second feeding point 21, to make two types of linear polarization purer and prevent another polarization direction from being generated after superposition, a point obtained after the start end of the first helical arm 1 is wound clockwise along the longitudinal direction of the axis of the antenna by 90 degrees may be configured as the first feeding point 11; and a point obtained after the start end of the second helical arm 2 is wound counterclockwise along the longitudinal direction of the axis of the antenna by 90 degrees may be configured as the second feeding point 21. In this way, cross polarization isolation of the two types of linear polarization can be improved, so that the two types of linear polarization are purer.

To facilitate description of a principle of synthesizing two types of linear polarization on the antenna shown in FIG. 2, an XYZ coordinate system may be established in FIG. 2. As shown in FIG. 2, when a current d is input through the second feeding port B, the current d is split into two at the intersecting point 3*a*, a current d1 enters the first helical arm 1, a current d2 enters the second helical arm 2, and flow directions of the current d1 and the current d2 are opposite. In this case, the first helical arm 1 starts left-hand circular polarization, the second helical arm 2 starts right-hand circular polarization, and current start directions of the left-hand circular polarization and the right-hand circular polarization are opposite. Therefore, linear polarization waves in a Y direction may be synthesized through superposition. As shown in FIG. 2, when a current e is input through the first feeding port A, two microstrips of a power divider form two currents e1 and e2 in opposite directions. When the current e1 and the current e2 respectively enter the first feeding point 11 and the second feeding point 21, the directions of the current e1 and the current e2 are same. In this case, the first helical arm 1 starts left-hand circular polarization, the second helical arm 2 starts right-hand circular polarization, and start directions of the left-hand circular polarization and the right-hand circular polarization are same. Therefore, linear polarization waves in an X direction are synthesized through superposition. In this way, two linear polarization waves that are perpendicular to each other can be formed.

Figure 3:
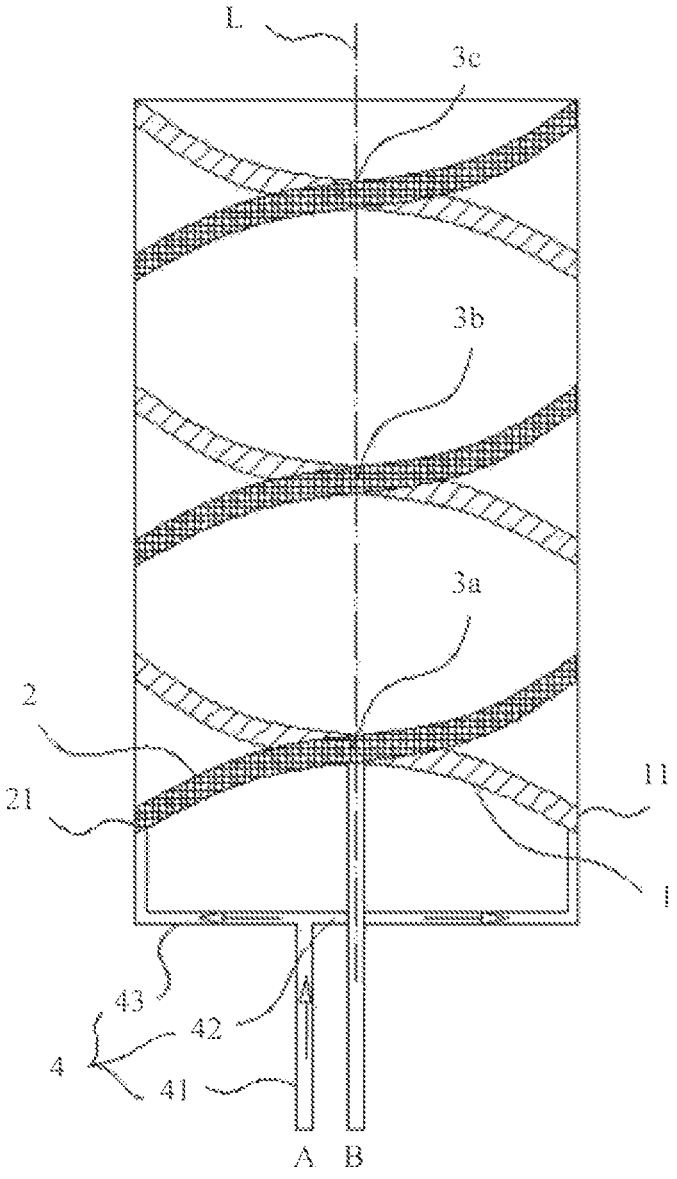
FIG. 3 is a schematic structural diagram of another implementation of an antenna according to an embodiment.

As shown in FIG. 3, in another possible implementation, a start end of a first helical arm 1 does not coincide with a start end of a second helical arm 2, and the start end of the first helical arm 1 and the start end of the second helical arm 2 are two points symmetrical relative to an axis of an antenna. In this case, the start end of the first helical arm 1 may be configured as a first feeding point 11, the start end of the second helical arm 2 may be configured as a second feeding point 21, and a third feeding point may be an intersecting point that is closest to the start end of the first helical arm 1 and the start end of the second helical arm 2.

Figure 4:
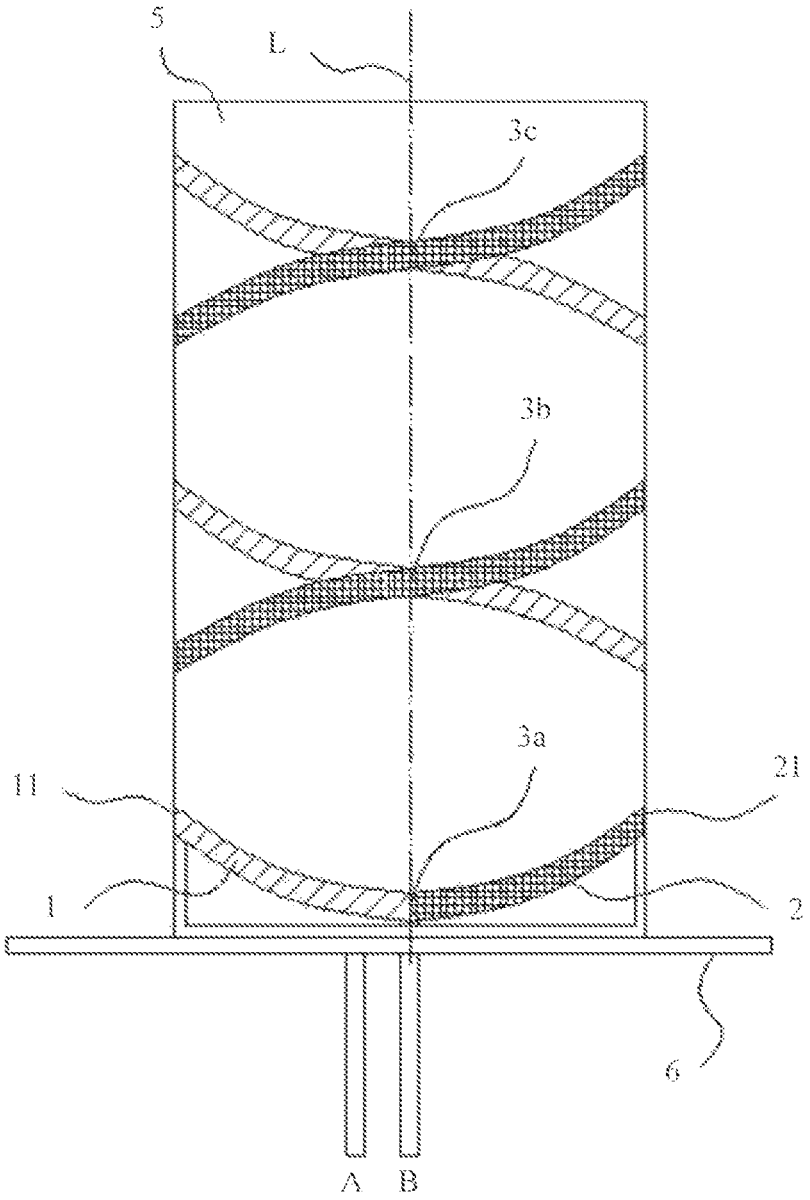
FIG. 4 is a schematic structural diagram in which an antenna is provided with a ground plane according to an embodiment.

Optionally, when materials of the first helical arm 1 and the second helical arm 2 are relatively hard metal (for example, a copper wire), a support body may not be disposed, and the copper wire may be directly bent into a helical shape. In this case, the helical shape of the copper wire may be maintained. As shown in FIG. 4, to secure the first helical arm 1 and the second helical arm 2 firmly, a support column 5 that is made of an insulating material may be further disposed. An axis of the support column 5 coincides with the axis of the antenna, the first helical arm 1 is wound clockwise around a side wall of the support column 5 along the longitudinal direction of the axis of the antenna, and the second helical arm 2 is wound counterclockwise around the side wall of the support column 5 along the longitudinal direction of the axis of the antenna. Therefore, the support column 5 can effectively support the first helical arm 1 and the second helical arm 2, so that an overall structure of the antenna is more stable and is unlikely to deform or be damaged.

As shown in FIG. 3, a first feeding port A may be connected to both the first feeding point 11 and the second feeding point 21 by using a power divider 4. An input end of the power divider 4 is connected to the first feeding port A, one output end of the power divider 4 is connected to the first feeding point 11, and another output end of the power divider 4 is connected to the second feeding point 21.

Specifically, as shown in FIG. 3, the power divider 4 may include a coaxial cable 41, a first microstrip 42, and a second microstrip 43. One end of the first microstrip 42 is connected to a first end of the coaxial cable 41, and the other end of the first microstrip 42 is connected to the first feeding point 11. One end of the second microstrip 43 is connected to the first end of the coaxial cable 41, and the other end of the second microstrip 43 is connected to the second feeding point 21. A second end of the coaxial cable 41 is connected to the first feeding port A. An electrical length of the first microstrip 42, an electrical length of the second microstrip 43, an electrical length from the start end of the first helical arm 1 to the first feeding point 11, and an electrical length from the start end of the second helical arm 2 to the second feeding point 21 may be equal to each other. It should be noted that the first microstrip 42 and the second microstrip 43 may alternatively be replaced with strip lines. This is not limited herein.

As shown in FIG. 4, the antenna further includes a ground plane 6. The start end of the first helical arm 1 and the start end of the second helical arm 2 are disposed close to the ground plane 6. A coaxial cable includes an inner conductor and an outer conductor, where the outer conductor is disposed outside the inner conductor and is electrically isolated from the inner conductor, the inner conductor is connected to both the first microstrip and the second microstrip, and the outer conductor is connected to the ground plane 6.

Figure 5:
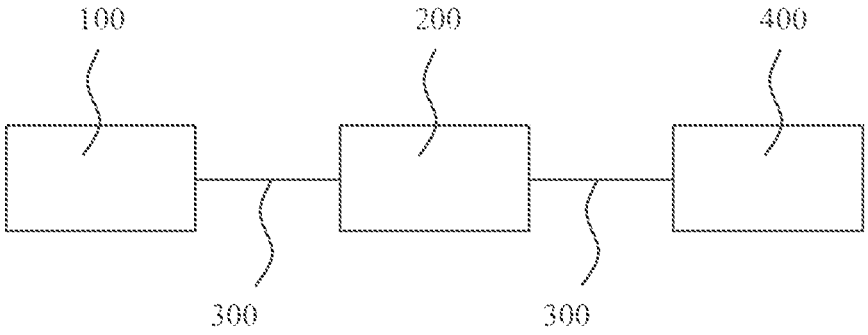
FIG. 5 is a schematic diagram of a connection relationship of a wireless device according to an embodiment.

As shown in FIG. 5, the wireless device includes a baseband 100, a radio frequency module 200, a cable 300, and an antenna 400. The radio frequency module 200 is connected to both the baseband 100 and the antenna 400 by using the cable 300, and the antenna 400 is the antenna disclosed by the embodiments. The radio frequency module 200 may also be referred to as a radio frequency system 200.

In an embodiment, the baseband 100 is configured to convert a digital signal into an intermediate frequency analog signal and send the intermediate frequency analog signal to the radio frequency module 200; the radio frequency module 200 is configured to convert the intermediate frequency analog signal into a radio frequency signal and send the radio frequency signal to the antenna 400; and the antenna 400 is configured to convert the radio frequency signal into an electromagnetic wave signal and radiate the electromagnetic wave signal in the air.

In a possible implementation, that the radio frequency module 200 converts the intermediate frequency analog signal into the radio frequency signal and sends the radio frequency signal to the antenna 400 includes: converting the intermediate frequency analog signal into the radio frequency signal; sequentially performing amplification processing and filtering processing on the radio frequency signal, to obtain a processed radio frequency signal; and sending the processed radio frequency signal to the antenna 400. Alternatively, that the radio frequency module 200 converts the intermediate frequency analog signal into the radio frequency signal and sends the radio frequency signal to the antenna 400 includes: converting the intermediate-frequency analog signal into a first unprocessed radio frequency signal; performing amplification processing on the first unprocessed radio frequency signal to obtain a second unprocessed radio frequency signal; and performing filtering processing on the second unprocessed radio frequency signal to obtain the radio frequency signal That the antenna 400 converts the radio frequency signal into the electromagnetic wave signal includes: converting the processed radio frequency signal into the electromagnetic wave signal.

It should be noted that the wireless device may be a microwave device, a base station, a Wi-Fi device, or the like.

The foregoing descriptions are merely specific implementations, but are not intended to limit the protection scope of the present disclosure. Any variation or replacement readily figured out by a person skilled in the art within the technical scope disclosed shall fall within the protection scope of the present disclosure. Therefore, the protection scope of the present disclosure shall be subject to the protection scope of the claims.

What is claimed is:

1. An antenna comprising:

a first axis;

a first helical arm wound clockwise along a longitudinal direction of the first axis;

a second helical arm wound counterclockwise along the longitudinal direction, wherein the first helical arm and the second helical arm form at least one intersecting point, and wherein the at least one intersecting point comprises a first intersecting point that forms a third feeding point;

a first feeding point disposed on the first helical arm;

a second feeding point disposed on the second helical arm, wherein the first feeding point and the second feeding point are symmetric relative to the first axis;

a first feeding port connected to the first feeding point and the second feeding point; and a second feeding port connected to the third feeding point.

2. The antenna of claim 1, wherein the at least one intersecting point comprises a plurality of intersecting points, and wherein the first intersecting point is closest among the intersecting points to the first feeding point and the second feeding point.

3. The antenna of claim 1, wherein a first start end of the first helical arm coincides with a second start end of the second helical arm to form the first intersecting point.

4. The antenna of claim 3, wherein a first point obtained after the first start end is wound clockwise along the longitudinal direction by 90 degrees (°) is the first feeding point.

5. The antenna of claim 4, wherein a second point obtained after the second start end is wound counterclockwise along the longitudinal direction by 90° is the second feeding point.

6. The antenna of claim 1, wherein a first start end of the first helical arm and a second start end of the second helical arm are symmetric relative to the first axis.

7. The antenna of claim 6, wherein the first feeding point is the first start end.

8. The antenna of claim 7, wherein the second feeding point is the second start end.

9. The antenna of claim 8, wherein the at least one intersecting point comprises a plurality of intersecting points, and wherein the first intersecting point is closest among the intersecting points to the first start end and the second start end.

10. The antenna of claim 1, further comprising a support column made of an insulating material.

11. The antenna of claim 10, wherein the support column has a second axis coinciding with the first axis of the antenna.

12. The antenna of claim 11, wherein the first helical arm is wound clockwise around a side wall of the support column along the longitudinal direction.

13. The antenna of claim 12, wherein the second helical arm is wound counterclockwise around the side wall along the longitudinal direction.

14. A wireless device comprising:

a cable;

a baseband configured to:

convert a digital signal into an intermediate-frequency analog signal, and send the intermediate-frequency analog signal;

a radio frequency system connected to the baseband using the cable and configured to:

receive the intermediate-frequency analog signal from the baseband, convert the intermediate-frequency analog signal into a radio frequency signal, and send the radio frequency signal; and an antenna connected to the radio frequency system using the cable and comprising:

a first axis, a first helical arm wound clockwise along a longitudinal direction of the first axis, a second helical arm wound counterclockwise along the longitudinal direction, wherein the first helical arm and the second helical arm form at least one intersecting point, and wherein the at least one intersecting point comprises a first intersecting point that forms a third feeding point, a first feeding point disposed on the first helical arm, a second feeding point disposed on the second helical arm, wherein the first feeding point and the second feeding point are symmetric relative to the first axis, a first feeding port connected to the first feeding point and the second feeding point, and a second feeding port connected to the third feeding point, wherein the antenna is configured to:

receive the radio frequency signal from the radio frequency system, convert the radio frequency signal into an electromagnetic wave signal, and radiate the electromagnetic wave signal in air.

15. The wireless device of claim 14, wherein the radio frequency system is further configured to convert the intermediate-frequency analog signal into the radio frequency signal by converting the intermediate-frequency analog signal into a first unprocessed radio frequency signal.

16. The wireless device of claim 15, wherein the radio frequency system is further configured to convert the intermediate-frequency analog signal into the radio frequency signal by performing amplification processing on the first unprocessed radio frequency signal to obtain a second unprocessed radio frequency signal.

17. The wireless device of claim 16, wherein the radio frequency system is further configured to convert the intermediate-frequency analog signal into the radio frequency signal by performing filtering processing on the second unprocessed radio frequency signal to obtain the radio frequency signal.

18. The wireless device of claim 14, wherein the at least one intersecting point comprises a plurality of intersecting points, and wherein the first intersecting point is closest among the intersecting points to the first feeding point and the second feeding point.

19. The wireless device of claim 14, wherein a first start end of the first helical arm coincides with a second start end of the second helical arm to form the first intersecting point.

20. The wireless device of claim 19, wherein a first point obtained after the first start end is wound clockwise along the longitudinal direction by 90 degrees (°) is the first feeding point, and wherein a second point obtained after the second start end is wound counterclockwise along the longitudinal direction by 90° is the second feeding point.

* * * * *